US005566766A

United States Patent [19]

Williams

[11] Patent Number: 5,566,766

[45] Date of Patent: Oct. 22, 1996

[54] METHOD FOR EXTINGUISHING TANK FIRES

[75] Inventor: Dwight Williams, Vidor, Tex.

[73] Assignee: Williams Fire And Hazard Control, Inc., Mauriceville, Tex.

[21] Appl. No.: 427,360

[22] Filed: Apr. 24, 1995

[51] Int. Cl.[6] ..... A62C 3/06

[52] U.S. Cl. ..... 169/43; 169/46; 169/66; 239/1; 239/71

[58] Field of Search ..... 169/43, 46, 47, 169/66, 68; 239/71, 155, 1

[56] References Cited

U.S. PATENT DOCUMENTS 5,240,078 8/1993 Worthington ..... 169/47

*Primary Examiner*—Gary C. Hoge

*Attorney, Agent, or Firm*—Sue Z. Shaper; Butler & Binion, L.L.P.

[57] ABSTRACT

A method for extinguishing flammable and combustible liquid tank fires using foam comprising empirically determining a footprint for a plurality of nozzles and configuring and aiming nozzles with respect to a tank such that predicted footprint and foam run would cover a tank surface with foam.

3 Claims, 11 Drawing Sheets

SQ. FT. = 39,741
APPLICATION DENSITY RATE = .18
MINIMUM APPLICATION = 7,153 GPM
FLOW = 7,000 GPM

SQ. FT. = 39,741
APPLICATION DENSITY RATE = .15
MINIMUM APPLICATION = 5,961 GPM
FLOW = 6,000 GPM

SQ. FT. = 49,063
APPLICATION DENSITY RATE = .16
MINIMUM APPLICATION = 7,850 GPM
FLOW = 8000 GPM

SQ. FT. = 49,063
APPLICATION DENSITY RATE = .2
MINIMUM APPLICATION = 9,813 GPM
FLOW = 10,000 GPM

SQ. FT. = 59,366
APPLICATION DENSITY RATE = .202 (ACTUAL)
MINIMUM APPLICATION = 11,992 GPM
FLOW = 12,000 GPM

SQ. FT. = 51,045
APPLICATION DENSITY RATE = .235
MINIMUM APPLICATION = 11,996 GPM
FLOW = 12,000 GPM

SQ. FT. = 75,926
APPLICATION DENSITY RATE = .21
MINIMUM APPLICATION = 15,944 GPM
FLOW = 16,000 GPM

SQ. FT. = 75,926
APPLICATION DENSITY RATE = .24
MINIMUM APPLICATION = 18,222 GPM
FLOW = 18,000 GPM

SQ.FT. = 82,916
APPLICATION DENSITY RATE = .22
MINIMUM APPLICATION = 18,242 GPM
FLOW = 18,000 GPM

SQ.FT. = 82,916
APPLICATION DENSITY RATE = .24
MINIMUM APPLICATION = 19,900 GPM
FLOW = 20,000 GPM

SQ. FT. = 93,435
APPLICATION DENSITY RATE = .21
MINIMUM APPLICATION = 19,621 GPM
FLOW = 20,000 GPM

SQ. FT. = 82,916
APPLICATION DENSITY RATE = .24
MINIMUM APPLICATION = 19,900 GPM
FLOW = 20,000 GPM

SQ. FT. = 93,435
APPLICATION DENSITY RATE = .256
MINIMUM APPLICATION = 23,920 GPM
FLOW = 24,000 GPM

SQ. FT. = 93,435
APPLICATION DENSITY RATE = .3
MINIMUM APPLICATION = 28,031 GPM
FLOW = 28,000 GPM

METHOD FOR EXTINGUISHING TANK FIRES

FIELD OF INVENTION

This invention relates to a method for extinguishing flammable and combustible liquid tank fires using foam.

BACKGROUND OF INVENTION

The past 18 years has witnessed several changes in the fire fighting industry. Foam delivery nozzles have enlarged their capacity from 500–1,000 gpm to 6,000–10,000 gpm, or higher. Fire hoses have increased in size from 2½" diameters to 5"–10" diameters. Foam pumper capacity has gone from 1,000 gpm to 2,500–6,000 gpm. Importantly, storage tanks for flammable and combustible liquids have increased in size dramatically from 125–150 feet diameter to 300–345 feet diameters.

Fire fighting procedures in the last eighteen years have also changed. A popular historic approach to extinguish a tank fire containing combustible or flammable liquid was to "surround and drown." Too often, however, the fire did not go out. The present inventor became one of the first in the field to recognize, through the review of numerous videos of tank fires, that foam, under the "surround and drown" system, was not reaching the full surface of the tank. The apparent reason was that the fire was "breathing", and in particular, there was an area, which came to be labeled the sweet spot, where the fire was taking in air (oxygen). Adjacent this sweet spot the fire would pulsatingly flame. A combination of sweet spot, breathing and thermal drafts was driving foam back and away from the middle of the tank surface.

Experience showed that the sweet spot typically lay just off of the center of the tank, and extending upwind approximately to the tank wall. For a variety of considerations, fire fighting nozzles are also upwind of the tank. The present inventor lead the field in revising techniques so that foam came to be applied predominantly toward the sweet spot.

For every tank size N.F.P.A. specifies a minimum "application density rate." Multiplying the square foot surface of a tank times the minimum "application density rate" yields a required minimum number of gallons per minute of foam that is to be applied. N.F.P.A. also specifies a minimum application time, e.g. 65 minutes. Applying the minimum g.p.m. foam for the minimum time should extinguish a tank fire. It became the present inventor's further experience, however, that applying a minimum gpm for the minimum time did not always lead to the extinction of a tank fire, even with foam applied predominantly to a sweet spot.

The above discovery led to the present invention. The inventor can demonstrate to the industry, in contrast to conventional wisdom, that each nozzle lays down a distinct footprint of foam. Conventional wisdom only considered it significant to measure a nozzle's maximum reach. The present inventor also teaches that foam has a "maximum run" on the top of flaming fluid. Maximum run is determined empirically to be approximately 100 feet. Putting together the above two discoveries, it can be demonstrated that if predicted footprints of foam require foam to "run" over 100 feet to completely cover a tank surface then notwithstanding applying a minimum, or even well over a minimum, "gallons per minute", and regardless of directing a significant amount of foam to the sweet spot, there will be areas of the tank that will not receive foam and there is some likelihood the fire will not go out.

As a result of the above discoveries, the present inventor teaches a method for configuring nozzles at a burning tank such that they not only satisfy the minimum application density rate prescribed by N.F.P.A. and cover the sweet spot, but they also provide, taking footprints and foam run limitations into account, a foam run to all of the walls of the tank. To so configure nozzles, the inventor empirically determines a footprint for each size of nozzle potentially usable.

The inventor's method can be used in designing for a fixed placement of nozzles in a dike system, permanently installed surrounding a tank, and/or for staging mobile nozzles around a burning tank.

SUMMARY OF THE INVENTION

A method is disclosed for assisting in extinguishing flammable and combustible liquid tank fires using foam. Footprints for a plurality of potentially configured nozzles are empirically determined through shooting foam from the nozzles onto a grid. Nozzles are then configured around a tank such that predicted footprint, adjusted for the height of liquid in the tank, will cover a tank surface with foam under the limitations of maximum foam run.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF PREFERRED EMBODIMENT

Each fire fighting nozzle, it has been discovered, and the present invention teaches, will lay down a characteristic footprint of foam in standard operation. Although flammable and combustible liquid tanks vary in diameter, they share an approximate common height, 50 feet (45 feet to 70 feet). Nozzle footprint studies can be run assuming a supply of a standard minimum water pressure, usually 100 psi, but possibly up to 125 psi, with the nozzles pointed in a standard inclination to the horizon. Given standard pressure, a nozzle and a particular foam concentrate, metered at an appropriate level, will have associated with it a characteristic "throw footprint". This footprint can be measured empirically by shooting the nozzle toward a grid laid out above the ground in a tank at an appropriate distance away. The observed mark of the perimeter of the foam on the grid describes the nozzle's footprint. Theoretical adjustments can be made for an increase or decrease in footprint due to potential height of liquid in a tank.

Experience and study show in addition that a given foam will run a limited distance over flaming liquid. The inventor empirically determines that maximum flow run for a foam.

Fire fighting nozzles are advantageously staged upwind of a burning tank. The sweet spot of the burning tank, that is the spot where the burning fluid appears to take in air, usually lies between the wall and the center of the tank in the upwind direction. Approximately 125 feet comprises a standard distance for configuring nozzles from a burning tank wall.

Each tank diameter has an application density rate prescribed by NFPA. Multiplication of the minimum application density rate times the square feet of surface area of the tank yields a minimum application rate of foam in gallons per minute.

The invention comprises a method for configuring nozzles from a tank such that their total gpm yields the minimum application gpm, their footprints tend to concentrate foam upon a predicted sweet spot of the tank while the combination of footprints does not require foam to run greater than an empirically estimated maximum foam run for the particular foam used.

Figure 1A:
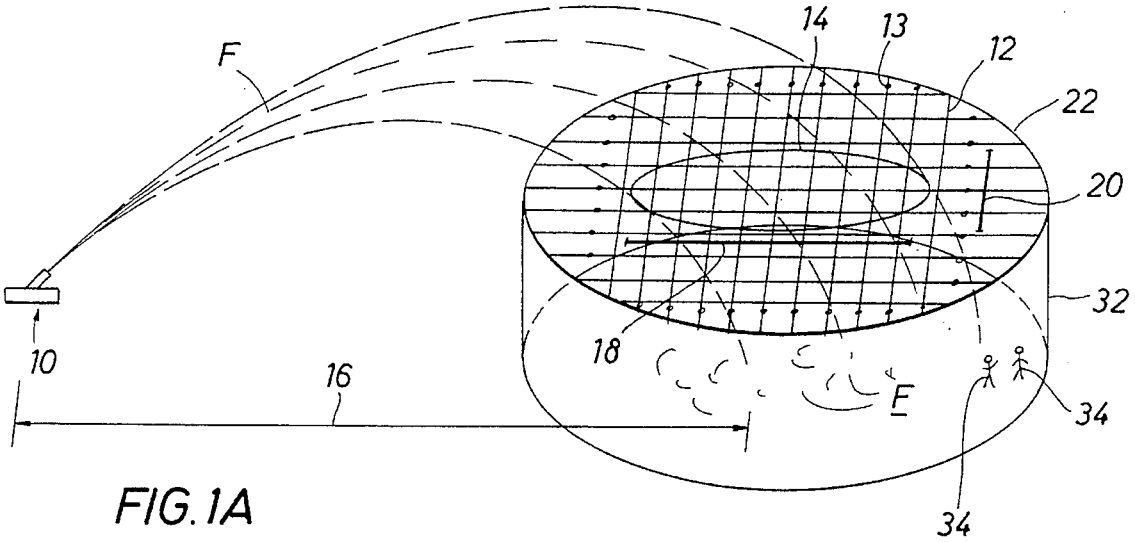
FIGS. 1A and 1B illustrates an empirical method for determining a nozzle footprint, and footprints so determined.
Figure 1B:
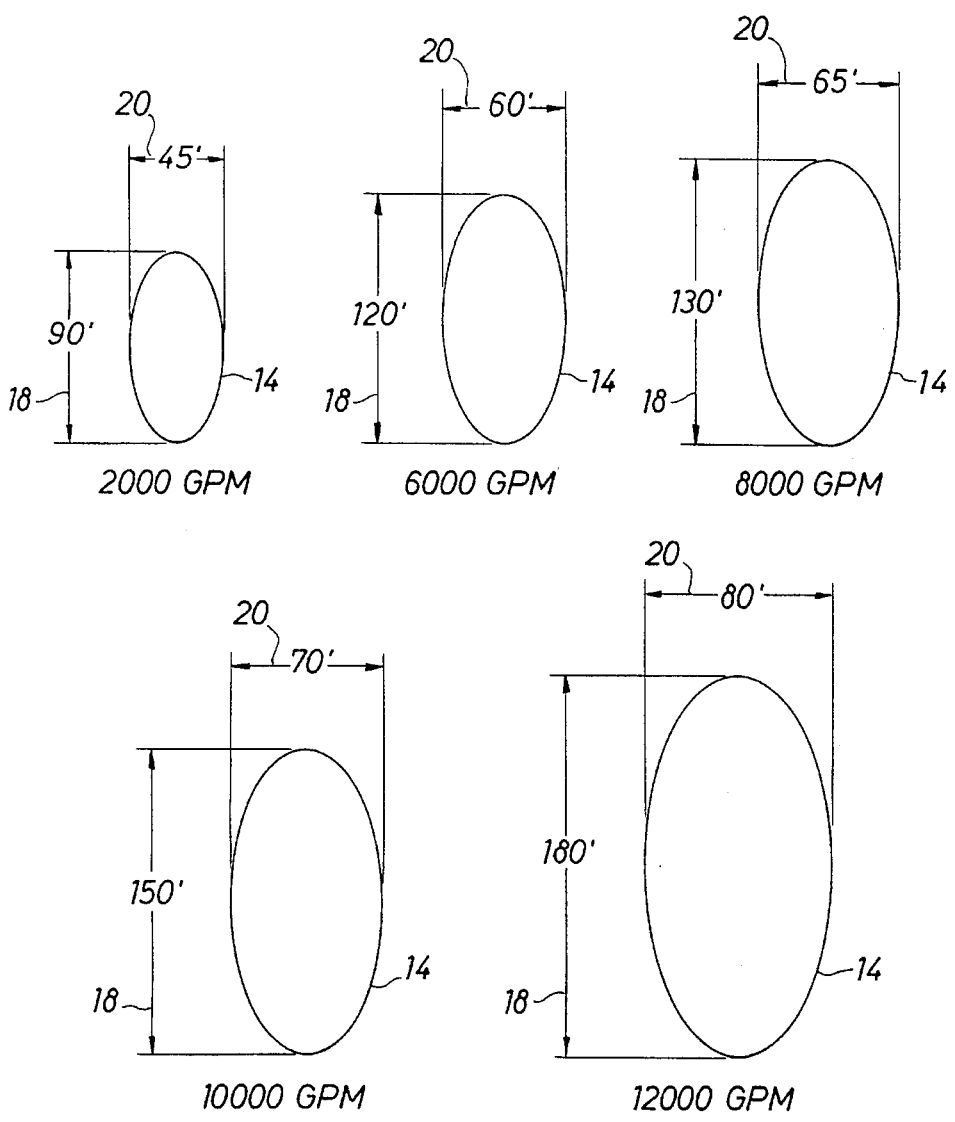

FIGS. 1A and 1B relate to the empirical method for determining the footprint of a nozzle. As illustrated in FIG. 1A, nozzle 10 is a standard distance 16 from an empty tank 32. Individuals 34 stand in the bottom of the empty tank. A grid of lines 12 are stretched across the top of the tank each line bearing flags 13. The lines may be stretched across the top of the tank laterally and longitudinally in approximately 10 foot intervals. Foam F is shot from nozzle 10. The individuals 34 on the ground in the tank observe the perimeter of the footprint 14 by observing which lines 12, more easily indicated by means of flags 13, are being touched by the perimeter of the foam as it passes through the rim 22 of tank 32.

FIG. 1B illustrates empirically determined footprints 14, the general length 18 and breadth 20 indicated for different nozzles using a particular foam.

Figure 2B:
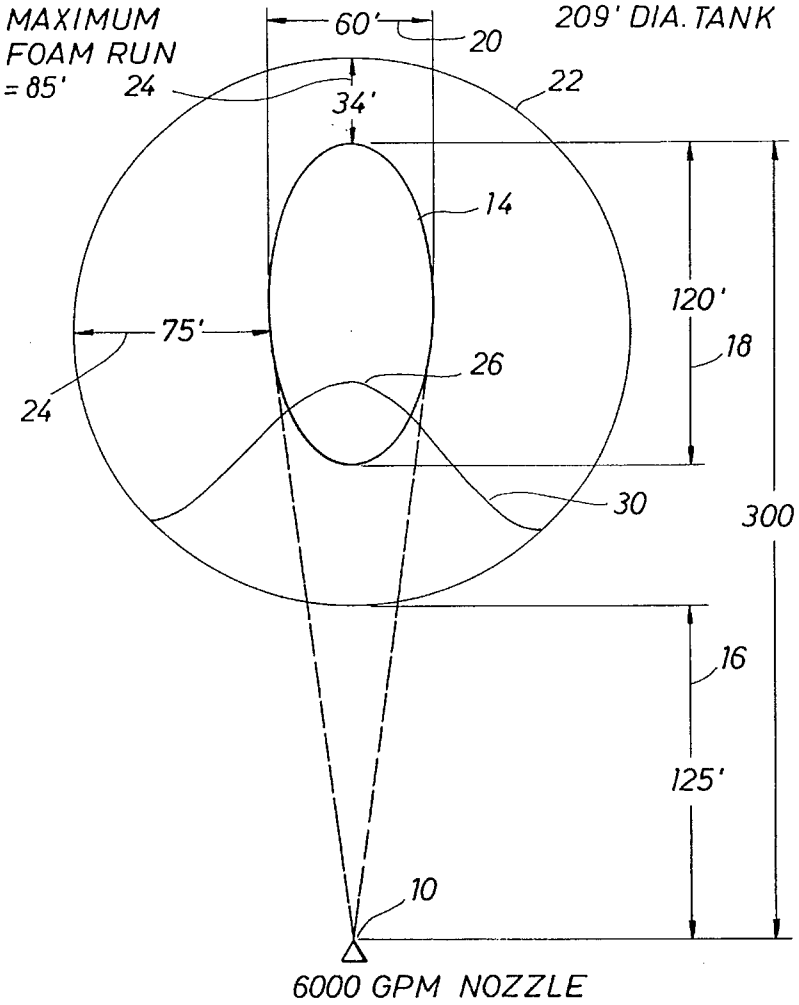
FIGS. 2A through 2T illustrate applications of the inventive method for different nozzles having different footprints and applied to different diameter tanks.
Figure 2A:
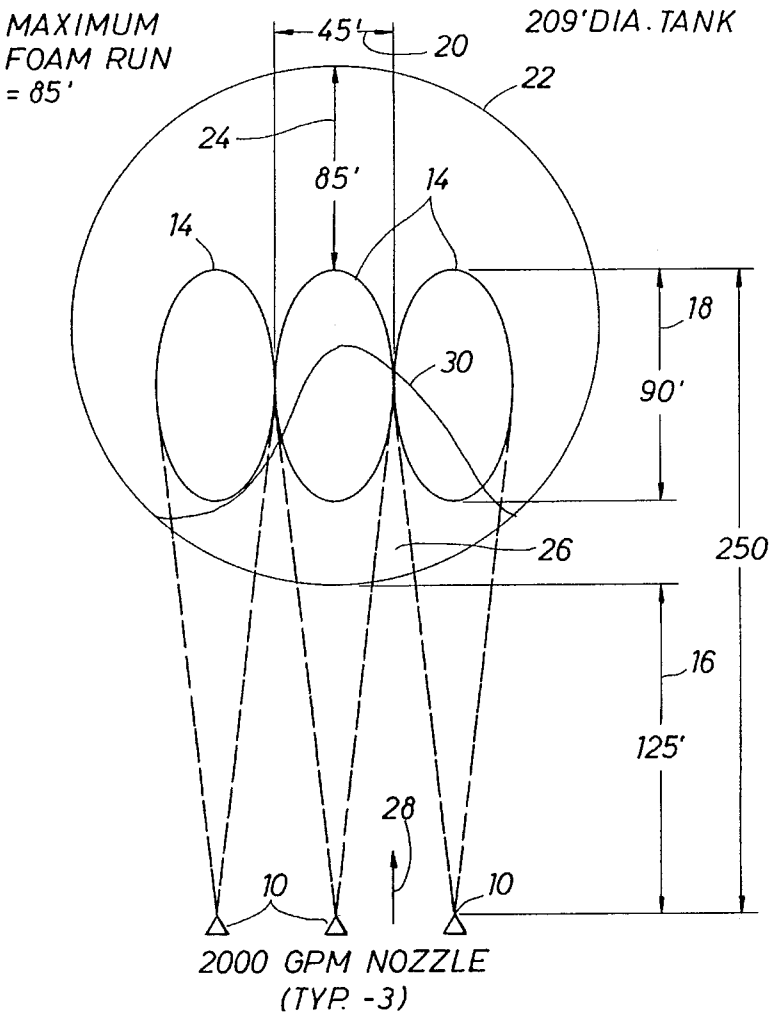
Figure 2D:
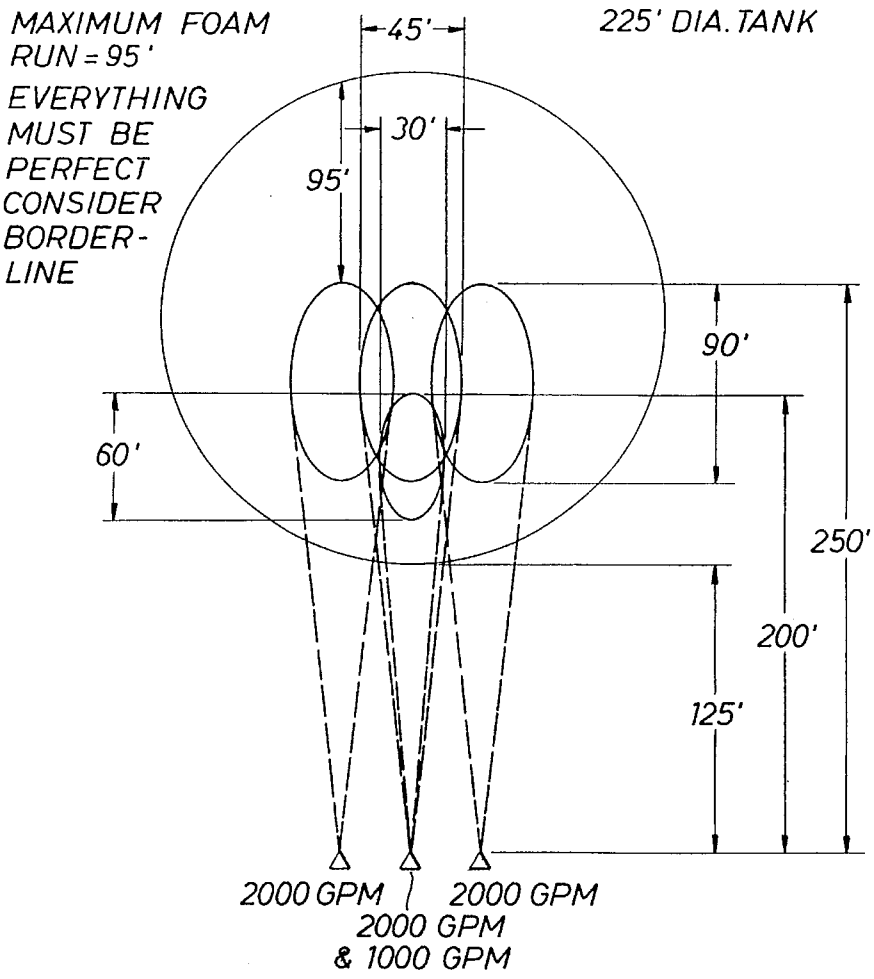
Figure 2C:
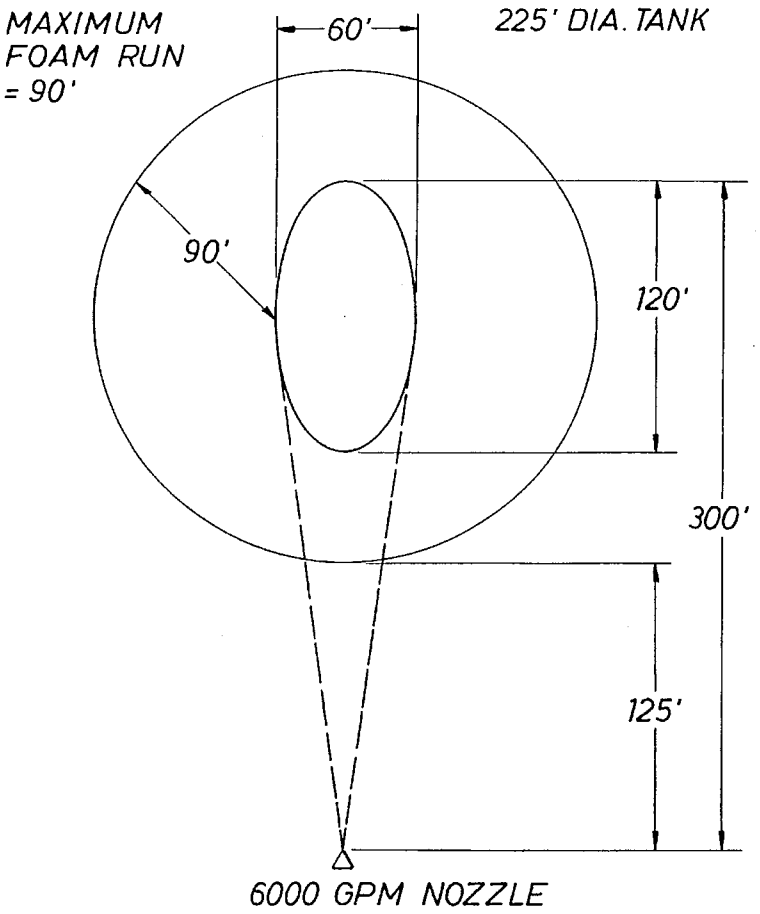
Figure 2F:
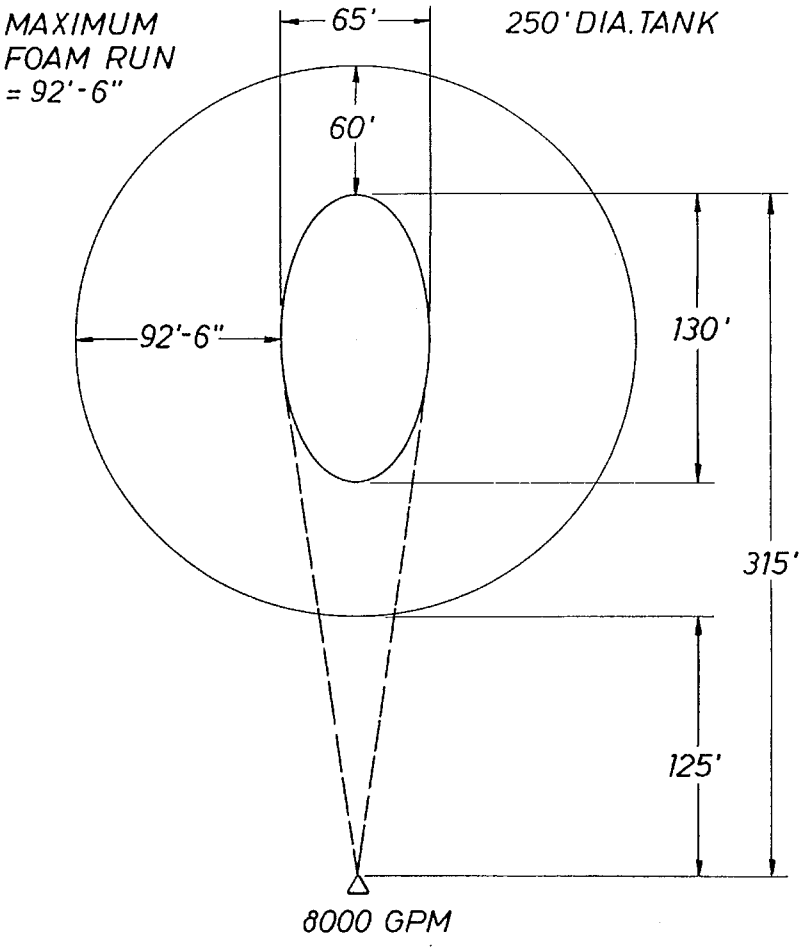
Figure 2E:
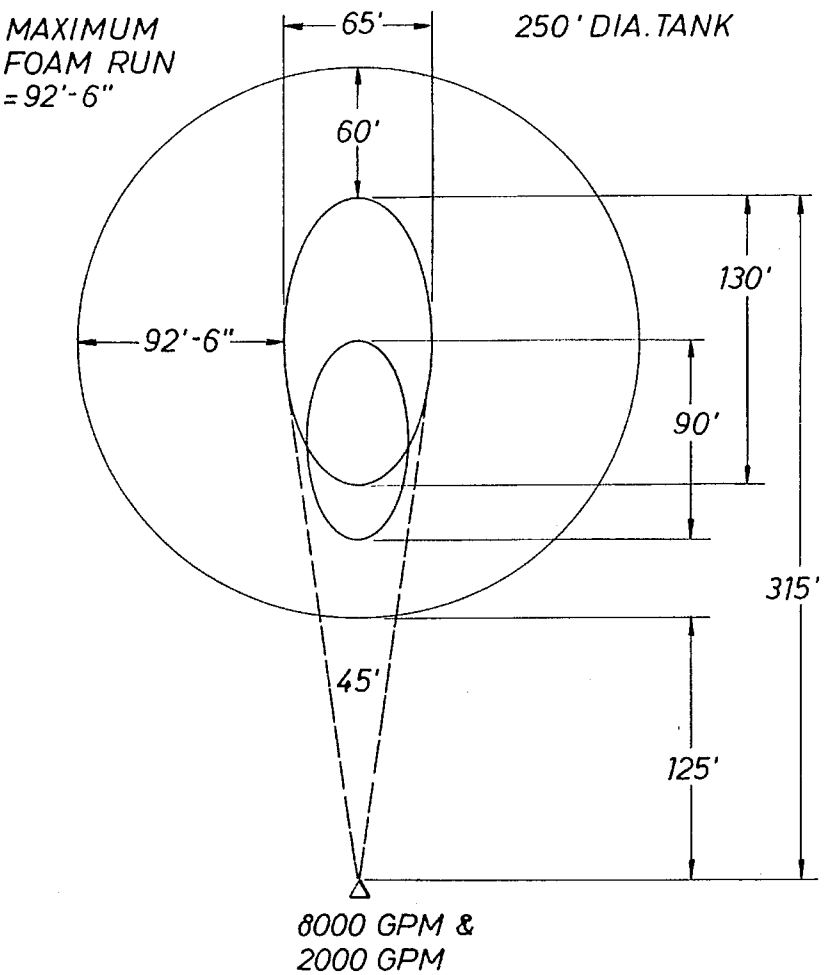
Figure 2H:
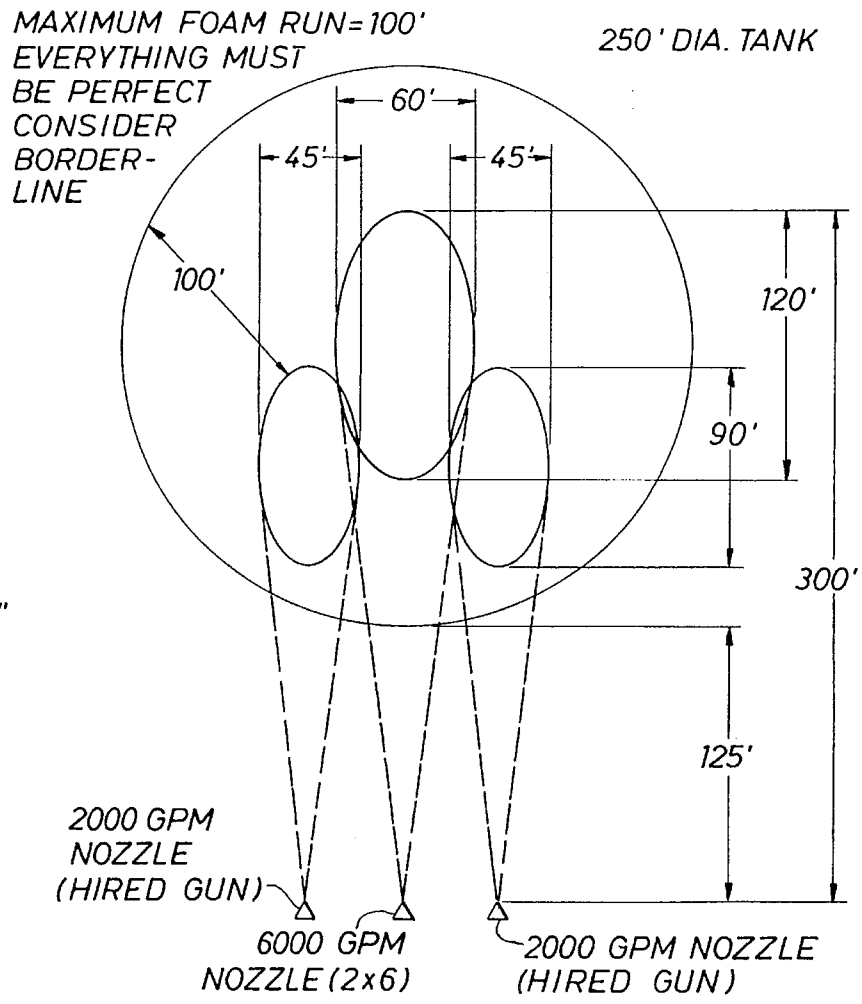
Figure 2G:
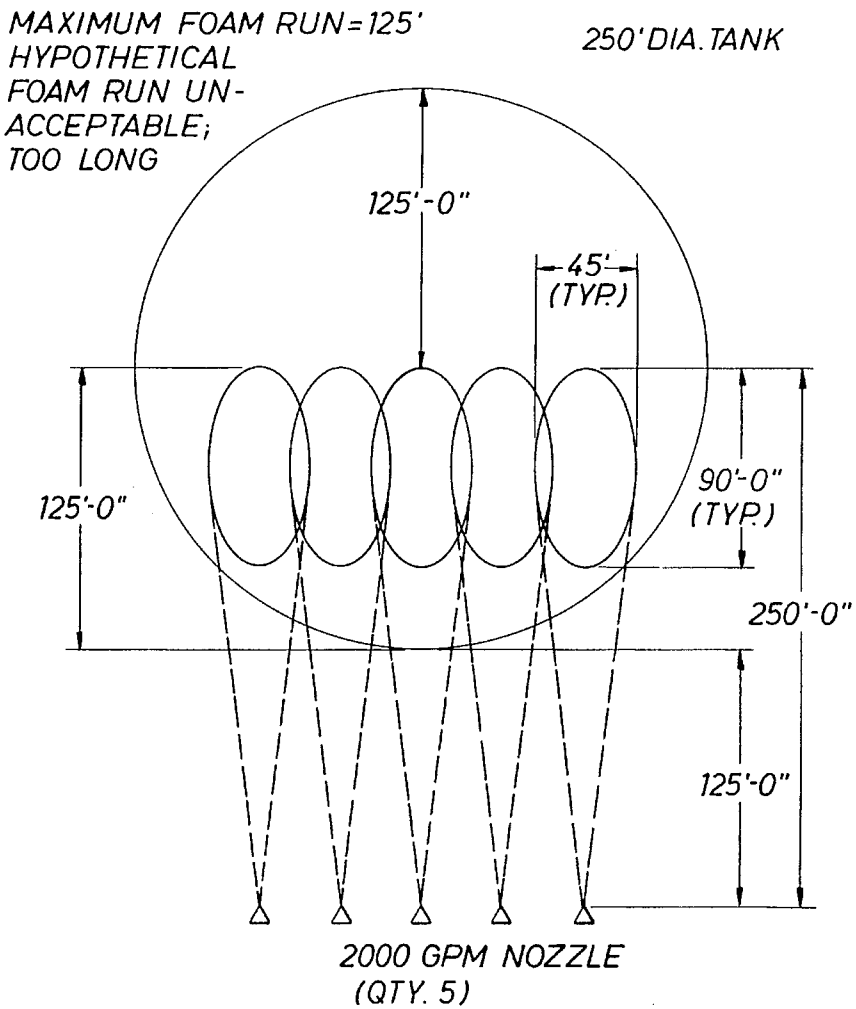
Figure 2J:
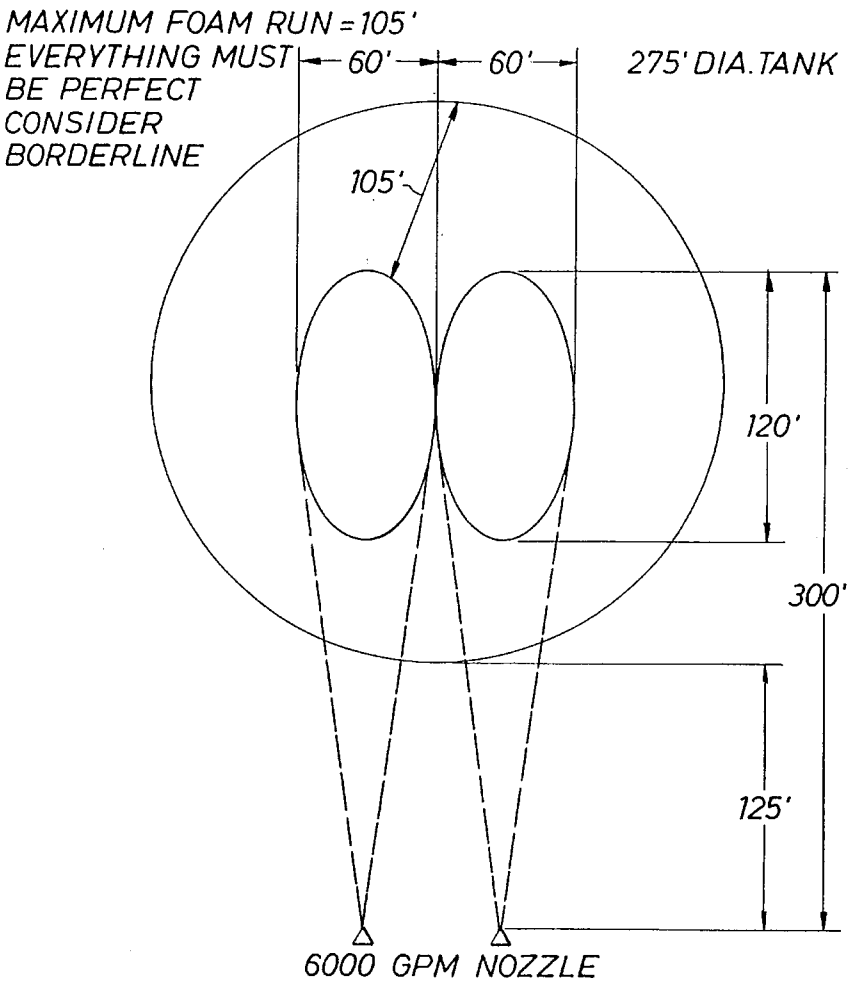
Figure 2I:
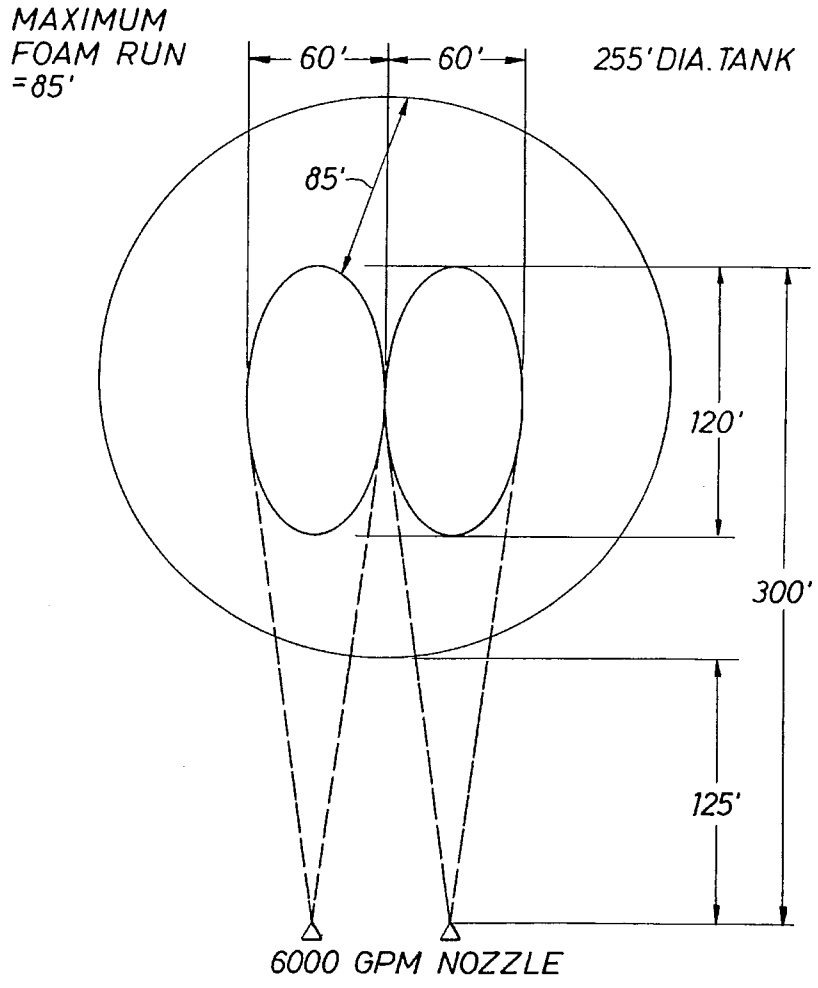
Figure 2L:
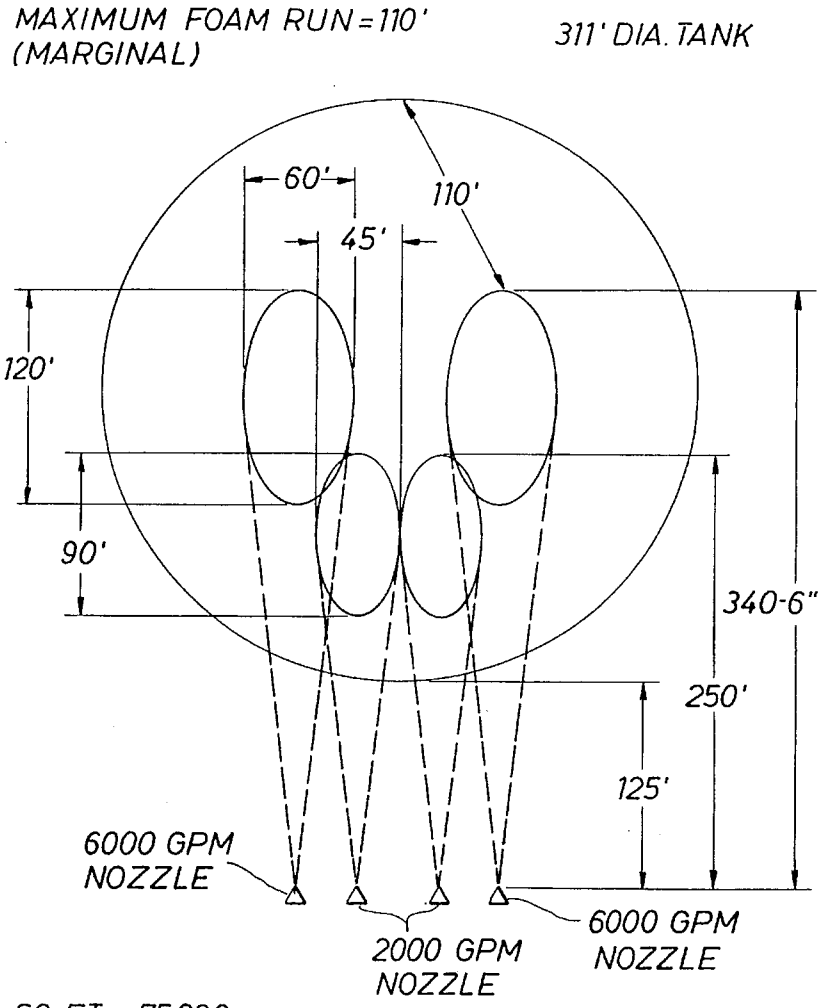
Figure 2K:
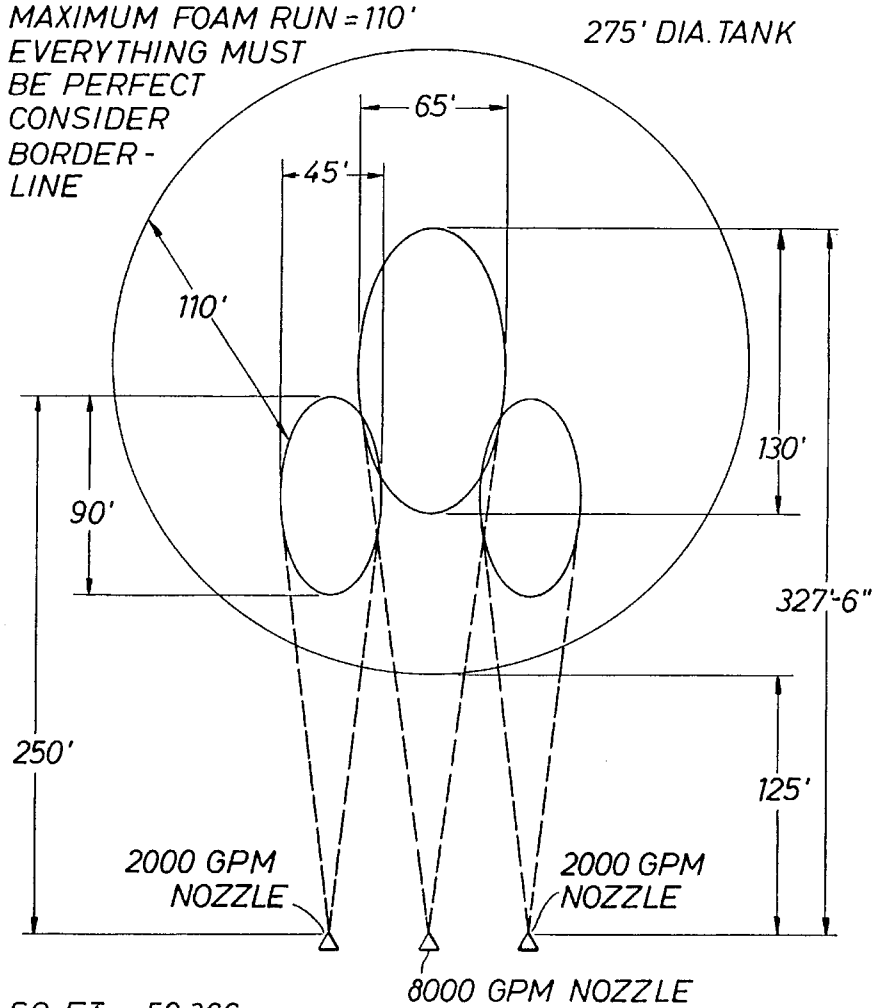
Figure 2N:
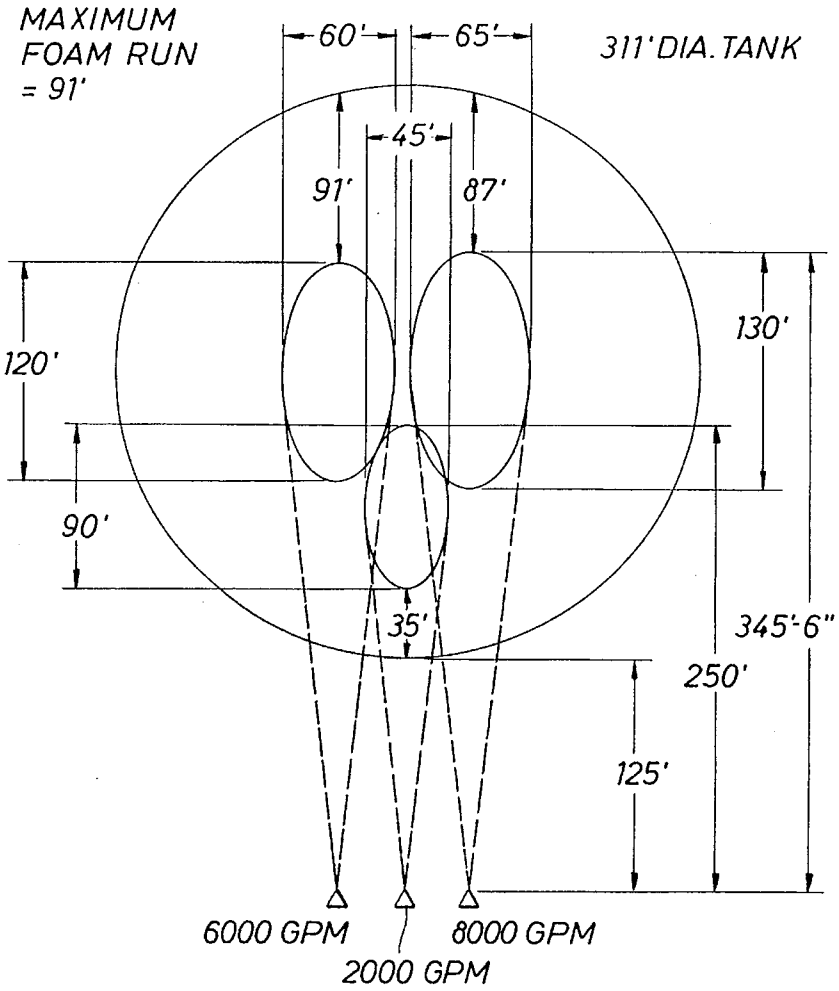
Figure 2M:
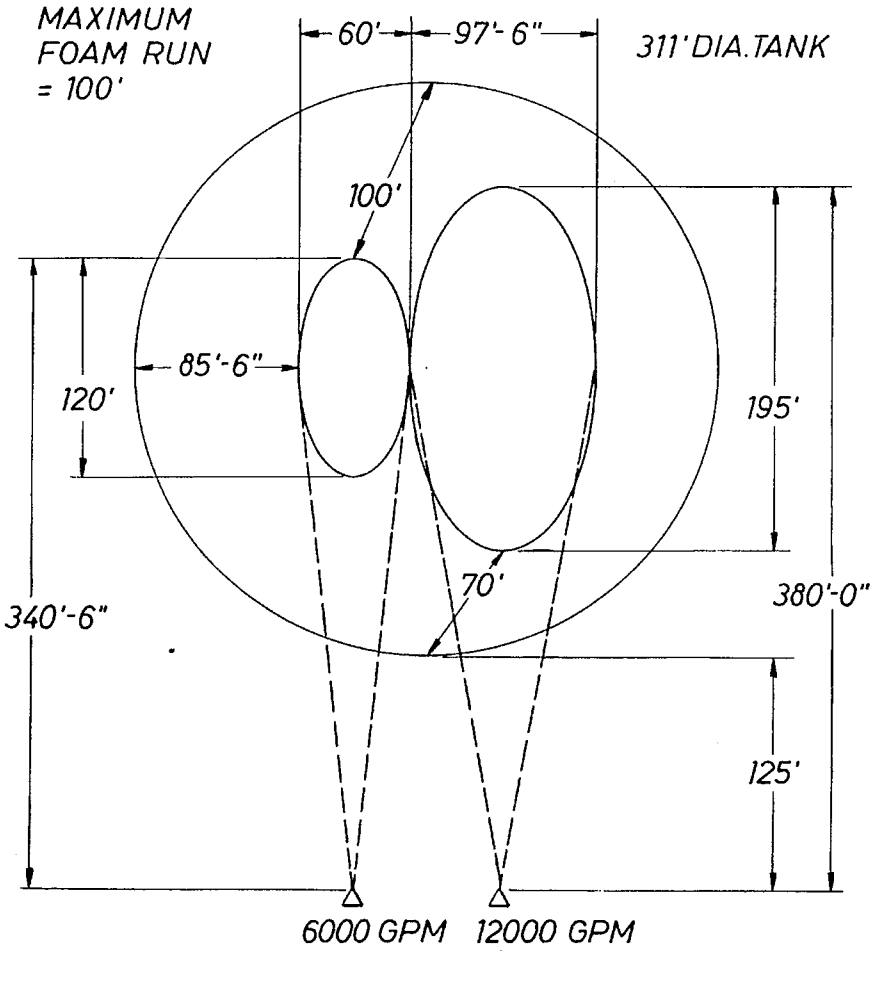
Figure 2P:
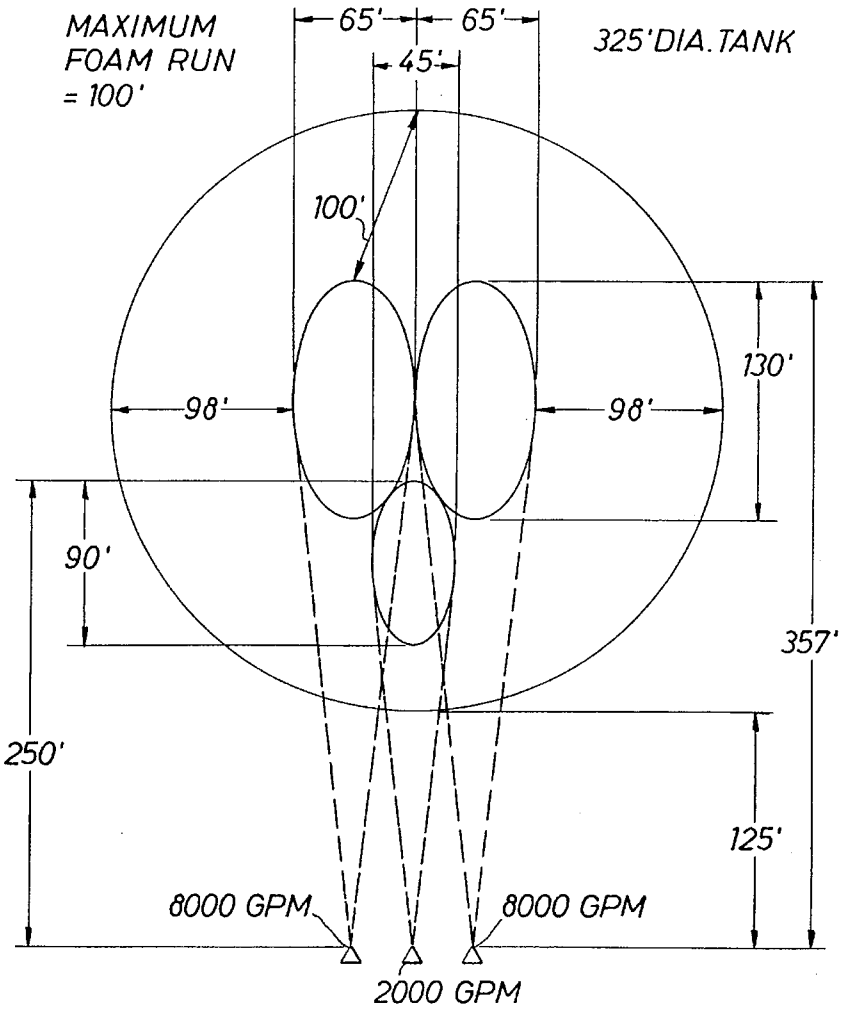
Figure 2O:
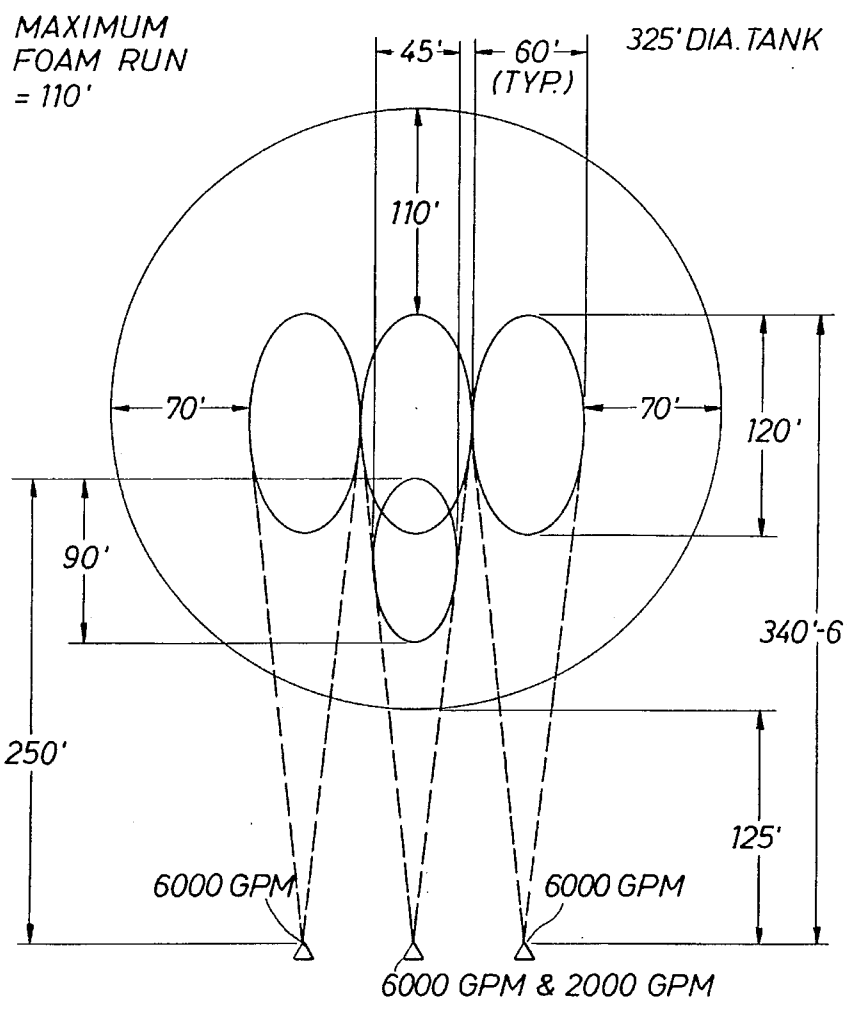
Figure 2R:
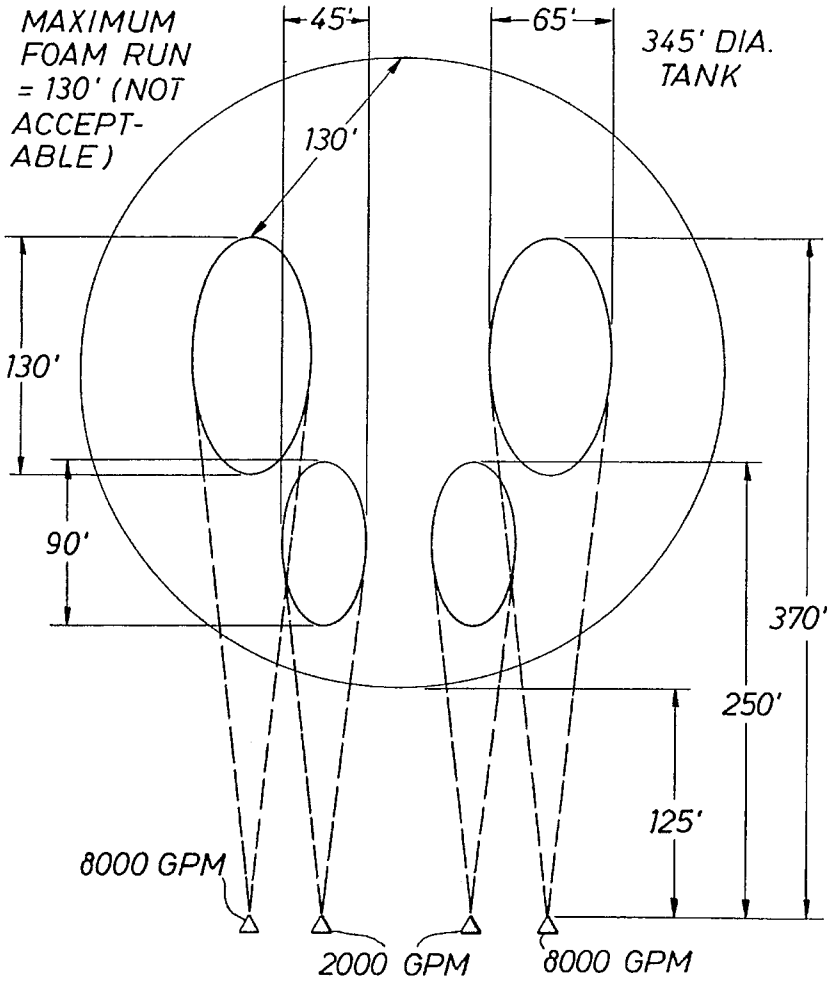
Figure 2Q:
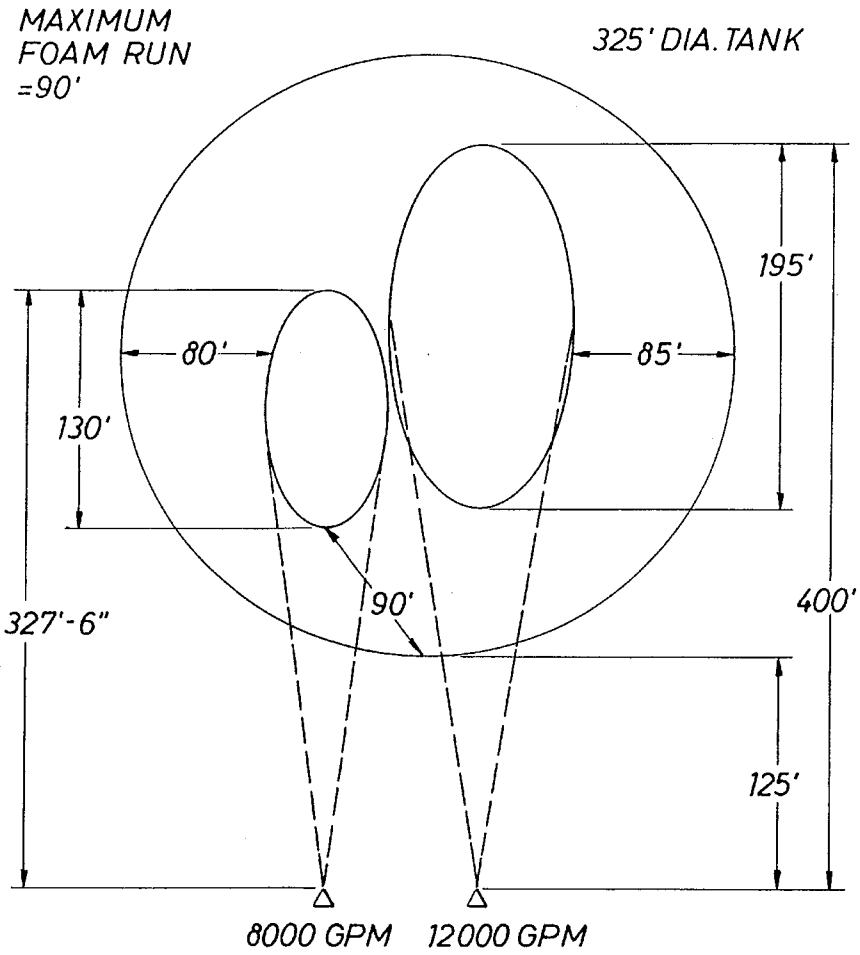
Figure 2T:
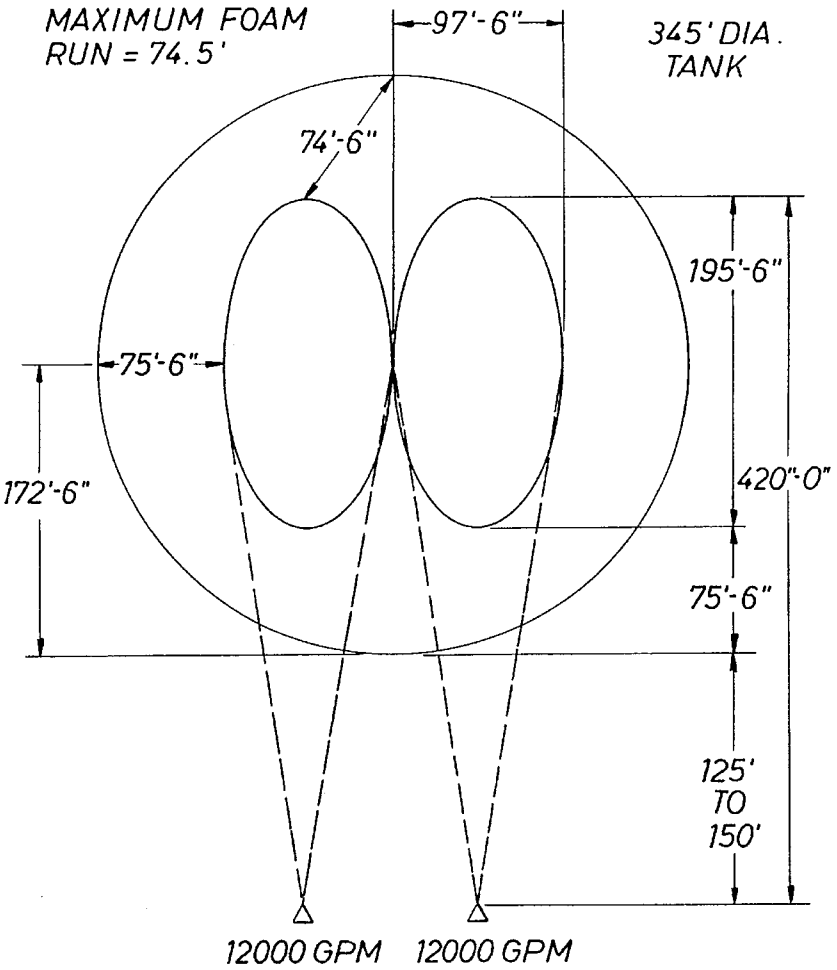
Figure 2S:
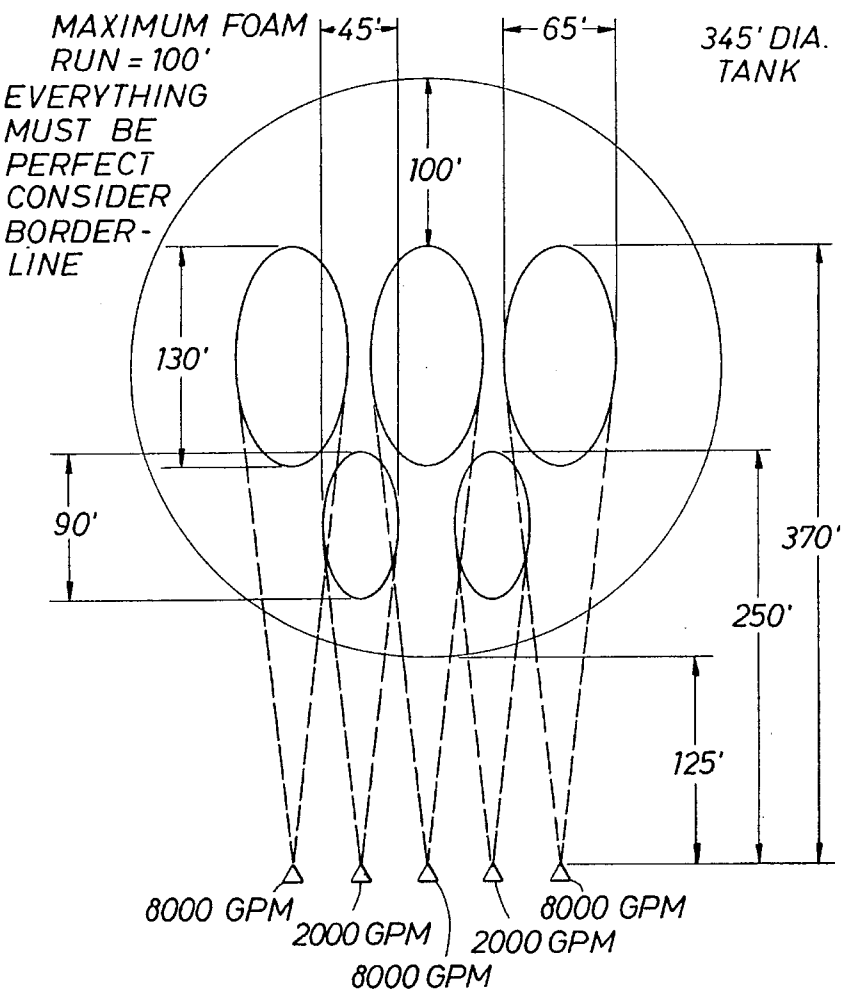

In the example of FIGS. 2A through 2T the maximum foam run for the particular foam used was approximately 100 feet.

More particularly, FIG. 2A illustrates a configuration for a 209 foot diameter tank 32. Three nozzles 10 are deployed and aimed. The nozzles are deployed distance 16 away from tank 32, which comprises a standard 125 feet. Footprints 14, empirically determined to be associated with particular 2,000 gpm nozzles 10, yield a concentration of foam around an estimated sweet spot area 26, more particularly defined by estimated boundary 30, while requiring a maximum foam run 24 of only 85 feet. It can be seen that a footprint of a 2,000 gpm nozzle has a general maximum breadth 20 of approximately 45 feet and a general maximum length 18 of approximately 90 feet.

FIG. 2B shows the application of the same method to the same 209 foot diameter tank 32 utilizing one 6,000 gpm nozzle 10. Again, the nozzle is deployed a standard distance 16 of 125 feet from tank wall 22. Predicted sweet spot 26 receives a significant foam concentration and the maximum foam run required can be held to 75 feet.

FIGS. 2C through 2T provide examples similar to FIGS. 2A and 2B.

The foregoing disclosure and description of the invention are illustrative and explanatory thereof. Various changes in the size, shape and materials as well as the details of the illustrated construction may be made without departing from the spirit of the invention.

What is claimed is:

1. A method for assisting in extinguishing flammable and combustible liquid tank fire using foam, comprising:

empirically determining a footprint for a plurality of nozzles; and configuring one or more nozzles with respect to a tank such that predicted nozzle footprint and predicted foam run would cover a tank surface with foam.

2. The method of claim 1 wherein empirically determining a footprint comprises shooting foam from a nozzle onto a grid and measuring the perimeter of the footprint.

3. The method of claim 1 wherein the predicted nozzle footprint includes an empirically determined adjustment for the height of the fluid in the tank.

* * * * *